US006729100B2

(12) United States Patent
Koski et al.

(10) Patent No.: US 6,729,100 B2
(45) Date of Patent: May 4, 2004

(54) MAIN TEE SPLICE

(75) Inventors: Gerald L. Koski, Parma, OH (US); John M. Harcula, Vermillion, OH (US); Brock R. Kavanagh, Avon, OH (US)

(73) Assignee: USG Interiors, Inc., Chicago, IL (US)

( * ) Notice: Subject to any disclaimer, the term of this patent is extended or adjusted under 35 U.S.C. 154(b) by 49 days.

(21) Appl. No.: 10/135,240

(22) Filed: Apr. 30, 2002

(65) Prior Publication Data

US 2003/0200719 A1 Oct. 30, 2003

(51) Int. Cl.[7] ..... E04B 9/22

(52) U.S. Cl. ..... 52/726.2; 52/726.1; 52/506.07; 52/664; 52/668; 403/346; 403/347

(58) Field of Search ..... 403/403, 346, 403/347; 52/726.2, 726.1, 506.07, 633, 664, 665, 667, 668, 669

(56) References Cited

U.S. PATENT DOCUMENTS

| | | | | |
|---|---|---|---|---|
| 2,689,630 A | | 9/1954 | Drury | 189/85 |
| 2,946,414 A | | 7/1960 | Gordon et al. | 189/36 |
| 3,169,614 A | | 2/1965 | McCoy | 189/82 |
| 3,221,466 A | * | 12/1965 | Downing, Jr. et al. | |
| 3,284,977 A | | 11/1966 | Licliter et al. | 52/573 |
| 3,286,427 A | | 11/1966 | Cotter | 52/583 |
| 3,288,489 A | | 11/1966 | Jahn | 287/189.36 |
| 3,297,345 A | | 1/1967 | Downing, Jr. | 287/189.36 |
| 3,350,125 A | | 10/1967 | Adams | 287/189.36 |
| 3,374,596 A | | 3/1968 | O'Brien et al. | 52/664 |
| 3,496,690 A | | 2/1970 | Jahn | 52/232 |
| 3,565,474 A | | 2/1971 | Stumbo et al. | 287/189.36 |
| 3,640,557 A | | 2/1972 | Nute, Jr. et al. | 287/189.36 A |
| 3,722,167 A | | 3/1973 | Rousey | 52/726 |
| 3,778,947 A | | 12/1973 | Sauer | 52/232 |
| 3,782,055 A | | 1/1974 | Spencer et al. | 52/758 D |
| 3,789,566 A | | 2/1974 | Boylan et al. | 52/573 |
| 3,846,031 A | | 11/1974 | Adams | 403/28 |
| 3,890,760 A | | 6/1975 | Jones | 52/758 A |
| 3,891,332 A | | 6/1975 | Molyneux et al. | 403/13 |
| 3,898,784 A | | 8/1975 | Sauer et al. | 52/758 A |
| 3,921,365 A | | 11/1975 | Nute, Jr. et al. | 52/758 A |
| 3,928,950 A | * | 12/1975 | Beynon | 52/726 |
| 3,979,874 A | * | 9/1976 | Cubbler, Jr. et al. | 52/664 |
| 4,161,856 A | | 7/1979 | Brown et al. | 52/667 |
| 4,208,851 A | | 6/1980 | Sauer | 52/573 |

(List continued on next page.)

*Primary Examiner*—Jeanette Chapman
(74) *Attorney, Agent, or Firm*—John M. Lorenzen; David F. Janci; Pearne & Gordon LLP

(57) ABSTRACT

A connector for a main tee of a suspended ceiling grid that has improved self-aligning and connection force properties. The connector has an end tab with a forward portion bent at a lead angle and a receiving pocket with an outwardly flared entrance that, with an opposed identical connector, cooperate to provide smooth horizontal alignment. The end portion, additionally, includes an edge profile that vertically aligns itself with the receiving pocket of the opposed connector. The receiving pocket includes a spring-like resilient wall that limits the assembly force to overcome interference with projecting lock lances even when the connectors are nearly out of dimensional tolerance. The spring-like pocket wall, shape of the lock lance, and reinforcing beads contribute to an improved audible click signaling that a connection has been completed. The lock lance works with a relief groove to augment self-alignment of the connectors.

10 Claims, 3 Drawing Sheets

U.S. PATENT DOCUMENTS

| | | | | | |
|---|---|---|---|---|---|
| 4,314,432 | A | | 2/1982 | Rosenbaum | 52/484 |
| 4,317,318 | A | | 3/1982 | Sauer | 52/667 |
| 4,317,641 | A | | 3/1982 | Sauer | 403/347 |
| 4,335,973 | A | | 6/1982 | Beck et al. | 403/300 |
| 4,389,828 | A | | 6/1983 | Cary | 52/665 |
| 4,462,198 | A | | 7/1984 | Sharp | 52/667 |
| 4,470,239 | A | | 9/1984 | Sauer | 52/777 |
| 4,484,428 | A | | 11/1984 | Sauer | 52/311 |
| 4,498,802 | A | | 2/1985 | Del Tufo et al. | 403/300 |
| 4,499,697 | A | | 2/1985 | LaLonde | 52/98 |
| 4,525,973 | A | * | 7/1985 | Vukmanic et al. | 52/664 |
| 4,531,340 | A | | 7/1985 | Sauer | 52/736 |
| 4,535,580 | A | | 8/1985 | Shirey | 52/484 |
| 4,549,383 | A | | 10/1985 | Vukmanic et al. | 52/667 |
| 4,606,166 | A | | 8/1986 | Platt et al. | 52/664 |
| 4,611,453 | A | | 9/1986 | Worley | 52/667 |
| 4,648,230 | A | | 3/1987 | Mieyal et al. | 52/667 |
| 4,677,802 | A | * | 7/1987 | Vukmanic | |
| 4,685,262 | A | | 8/1987 | Meredith, Jr. | 52/232 |
| 4,785,603 | A | * | 11/1988 | Platt | 52/667 |
| 4,850,172 | A | | 7/1989 | Gailey et al. | 52/665 |
| 4,989,387 | A | | 2/1991 | Vukmanic et al. | 52/667 |
| 5,088,261 | A | | 2/1992 | Mieyal et al. | 52/729 |
| 5,137,390 | A | | 8/1992 | Felsen | 403/347 |
| 5,271,202 | A | | 12/1993 | Vukmanic et al. | 52/667 |
| 5,517,796 | A | | 5/1996 | Koski et al. | 52/506.07 |
| 5,617,694 | A | | 4/1997 | Baba | 52/712 |
| 5,619,833 | A | | 4/1997 | Neff | 52/506.07 |
| 5,687,525 | A | | 11/1997 | Koski et al. | 52/506.07 |
| 5,761,868 | A | | 6/1998 | LaLonde et al. | 52/506.07 |
| 5,839,246 | A | | 11/1998 | Ziegler et al. | 52/506.07 |
| 5,979,134 | A | | 11/1999 | Neff | 52/506.07 |
| 6,047,511 | A | | 4/2000 | Lehane et al. | 52/506.07 |
| 6,138,425 | A | | 10/2000 | Wendt | 52/506.07 |
| 6,305,139 | B1 | * | 10/2001 | Sauer | 52/506.07 |

* cited by examiner

MAIN TEE SPLICE

BACKGROUND OF THE INVENTION

The invention relates to improvements in suspended ceiling grid components and, in particular, to end connectors for main runners or tees of such systems.

PRIOR ART

It is difficult to produce a main tee grid connector with previously known designs that is consistently easy to assemble in the field and that will result in a reliable and positive interconnection. Various known end connectors for main runners or tees can be somewhat difficult to install for numerous reasons. Such connectors may not be self-aligning and if they have provisions for self-alignment, their performance in this regard may be marginal at best. Smooth engagement and coupling between end connectors can be obstructed where the configuration of the connector parts have prominent surfaces or projections that interfere with the advance of mating end connectors.

Typically, main runners are 12' long and are installed by a technician who, during an installation, grasps the runner, relative to the end being joined to a preceding runner, on the far side of its center. This permits proper balance and allows the technician to be in a suitable position to initially tie the runner up in suspended position. Thus, the technician is at least 6' away from the joint so that it is difficult for the technician to clearly see the end receiving pocket of the preceding runner. Moreover, from this location, the technician cannot cup the ends to be joined in one hand to align them together. Consequently, there remains in the art, a need for an end connection or splice system that affords improved self-aligning capability.

A more subtle but sometimes more troublesome problem occurs when the end connectors are out or nearly out of dimensional tolerance due to variations in material stock, tool wear or other manufacturing conditions. In this circumstance, the forces required to connect the ends of the runners may vary from one runner to the next so that the technician installing the grid is confounded by not knowing for sure if a good connection is being made. Additionally, these dimensionally marginal parts can require excessive assembly force, again to the distraction or frustration of the technician.

SUMMARY OF THE INVENTION

The invention provides an end connector or "splice" for main runners or tees that has improved self-aligning properties and that provides greater consistency and comparatively lower levels in the force required to complete a connection. The connector of the invention includes an end tab that is configured to align itself with an identical opposing connector to which it is being joined. The connector further includes a resilient pocket receiving area for the end tab of the opposing connector that avoids both high assembly force levels and widely varying assembly force levels in the installation of one runner to the next.

In the illustrated embodiment, the end tab has elements for aligning itself to the receiving pocket of an opposed connector in both the vertical and horizontal directions. The vertical alignment feature is advantageously effective from a condition where the end tab misalignment is physically limited by the flange of the opposed tee runner. This structure enables a connection to be made where the end tab is first laid on the flange of the opposing previously installed runner and then is simply subjected to an endwise force by the installer. The leading profile of the end tab is effective, in the vertical location established by the flange of the opposed tee, to cam the end tab towards alignment with the mating connector. The vertical self-aligning character of the end tab is augmented by a lock lance element that registers with a groove in an opposed connector end tab. The vertical alignment action of the lock lance is assisted by horizontal alignment elements of the connector. The horizontal alignment elements of the connector comprise a lead angle formed by bending the forward portion of the end tab out of the plane of a main portion of the end tab and an outwardly flared entrance to the end tab receiving pocket. These lead angle and flared entrance elements provide relatively large, smooth camming surfaces, as compared to edge areas, that improve the smooth functioning of the connector. The lead angle of the end tab and outward flare of the opposed connector are readily inter-engaged for horizontal alignment. Additionally, these lead angle and outward flare components avoid any direct edge-to-surface contact between these components so that smooth sliding action occurs when the lock lance moves out of the relief groove of the opposed connector in the late stages of the assembly movement where the potential interference between the connectors is greatest.

The disclosed connector is arranged to produce an audible click when a connection is completed and, therefore, signal the same to the installer technician. The repeatability and loudness of the click is the result of several structural elements of the connector. The lock lance has a locking edge configured to cause it to snap over a mating edge of the opposed connector without interference with the locking edge of the opposing connector. The resilient character of the receiving pocket of the opposed connector imparts kinetic energy to the end tab when its lock lance snaps over the locking edge of the opposed connector. The end tab, additionally, has stiffening ribs which increase the sharpness of the click made by the snap-over of the lock lance.

DESCRIPTION OF THE PREFERRED EMBODIMENTS

Figure 1:
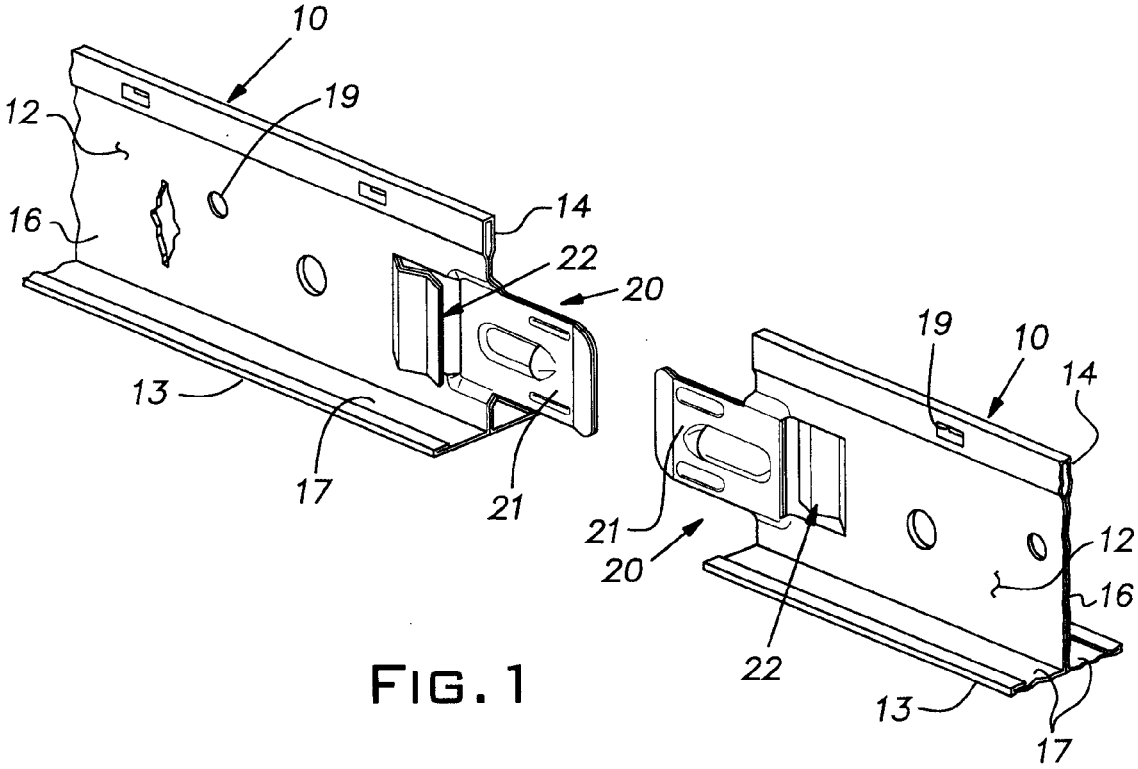
FIG. 1 is a perspective view of end portions of two main runners or tees shown prior to their endwise assembly or connection.

Referring now to the drawings, there is shown an end portion of a main runner or tee 10 of a general type commonly used for suspended ceiling grid systems as known in the art. Typically, such main runners or tees 10 are combined with cross runners or tees (not shown) to create a suspended grid work. In the illustrated example, the main tee 10 is made of two formed metal strips 12, 13 typically of steel, although other material such as aluminum can be used. One of the strips 12 forms an upper hollow bulb 14, a double wall web 16, and oppositely extending flanges 17 all integral with one another. The strip 12 can have, for example, a thickness of 0.012" to 0.027" depending on the application. The other strip 13 lies under the flanges 17 and is wrapped around the distal edges of the flanges 17 to lock the strip 12 in its tee shape, conceal the seam between the flanges 17 and provide a smooth appearance for a lower face 18 of the tee 10; the lower face 18 of the strip 13 typically is painted for appearance purposes. The lower strip 13 is a suitable material, typically steel, but can be other materials such as aluminum. Holes 19 through the web 16 enable the tee 10 to be suspended by wire or other means as is known in the art. It will be understood that the runner 10 can have various other shapes, besides a conventional tee shape as is known in the art.

The runner or tee 10 has an end connector or splice 20 that, in the illustrated case, is integral with the web 16. It will be understood that certain features of the invention can be applied to connectors that are formed in a single web wall or layer or are formed wholly or partially as separate elements that are joined to the main parts of a runner with rivets or other means as is known in the art. As is conventional, a runner or tee 10 will have a connector 20 at each end.

The connector 20 includes an end tab 21 and an end tab receiving pocket 22 that, as explained below, cooperate with an identical connector in the manner of a "handshake" to connect the opposed ends of two aligned tees or runners 10 together. The end tab 21 and pocket 22 are die cut and formed by suitable stamping dies. The end tab 21 projects from an imaginary vertical plane perpendicular to the lengthwise direction of the tee 10 and located where the lower face 18 terminates, this location being the nominal end of the tee proper. Major or "land" portions of the end tab 21 are planar and are offset from the plane of the center of the tee 10 (where the walls of the web 16 abut) by a distance at least equal to the thickness of the stock forming the walls of the web (i.e. the thickness of one web wall). As will be understood, this will allow a face of an end tab 21 to mate with the face of another end tab substantially at the mid-plane of each of the tees 10 being joined or connected.

The side profile of the end tab 21 is generally rectangular having two parallel horizontal edges 23, 24 at the top and bottom, respectively. A plane of an end portion or lead angle 26 is at an acute angle of about 35°, for example, from the plane of the end tab proper to the side of the tee 10 from which the end tab is offset.

A lock lance 27 is stamped into a forward area of the end tab 21 at mid-height of the end tab. The lock lance 27 projects from the plane of the end tab proper to the same side to which the lead angle end portion 26 is bent and from which the end tab is offset. The lock lance 27 is bulbous and preferably has the general shape of a longitudinal half of a bullet. A locking edge 28 of the lance 27 is originally cut by a stamping die from a line common to an end edge 29 of a relief and alignment groove 31. The lock lance edge 28 is originally cut in the plane of the end tab proper on a line that is curved on a radius or radii centered away from the main tee proper, i.e. this cut line is convex with reference from the main tee proper. The result of this curved cut line geometry, when the lock lance is caused to protrude from the plane of the end tab proper, is that the free locking edge 28 forms an angle when viewed in a vertical direction as in FIG. 3 that is about 90° or less. Thus, the apex or mid-point of the edge 28 furthest from the plane of the end tab proper is, ideally, situated at least as far back from a front edge 32 of the end tab 21 as remaining parts of this edge 28.

The relief groove 31 is vertically aligned with the lock lance 27 and extends longitudinally rearwardly from the lock lance to a somewhat rounded end 33 adjacent the receiving pocket 22. The relief groove 31 has a depth about equal or more than the height of the lock lance 27 and a width moderately larger than that of the lock lance.

A pair of beads or small ribs 34 extending longitudinally from a bend line 36 between the lead angle end portion 26 and end tab proper are stamped into the material of the end tab and project to a side of the end tab opposite that of the lock lance 27. The beads 34 are parallel to the edges 23, 24 and extend rearwardly somewhat beyond the lock lance 27 and thereby stiffen the end tab 21 across a weakened line existing where it is cut to form the lock lance edge 28 and groove end edge 29.

Figure 3:
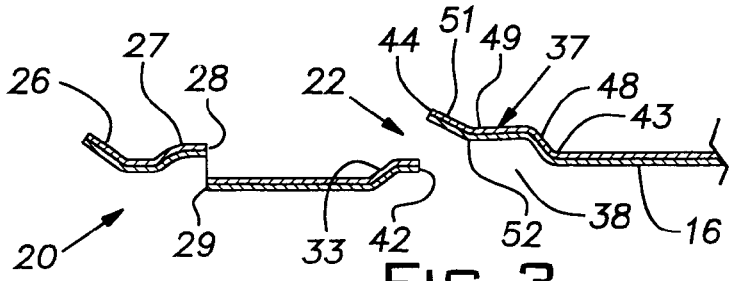
FIG. 3 is a fragmentary cross-sectional view of the connector area taken along the line 3—3 in FIG. 2.
Figure 5:
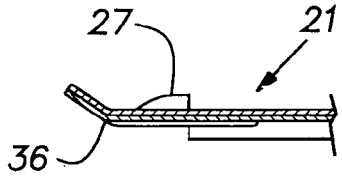
FIG. 5 is a fragmentary cross-sectional view of the end tab taken along the line 5—5 in FIG. 2.
Figure 4:
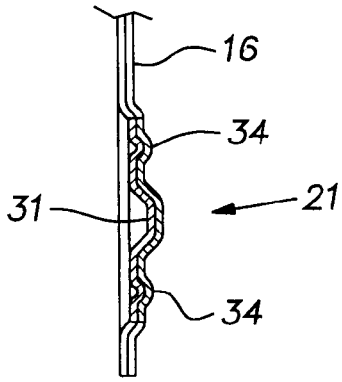
FIG. 4 is a cross-sectional view of the end tab taken along the line 4—4 in FIG. 2.
Figure 6:
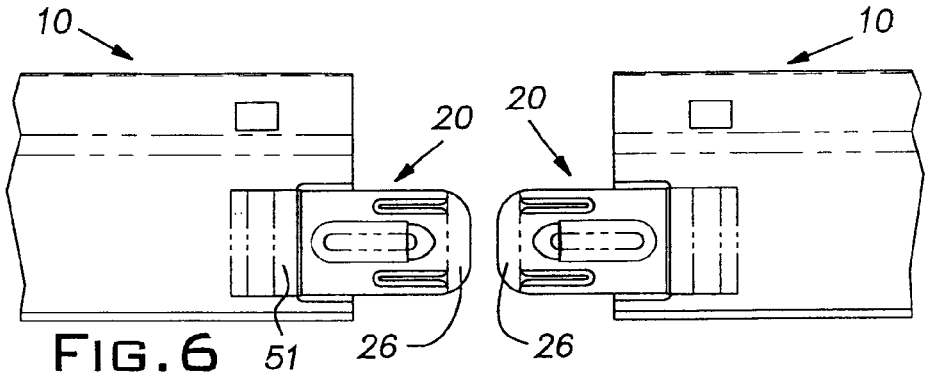
FIG. 6 is a side elevational view of an opposed pair of connectors prior to their connection.
Figure 6A:
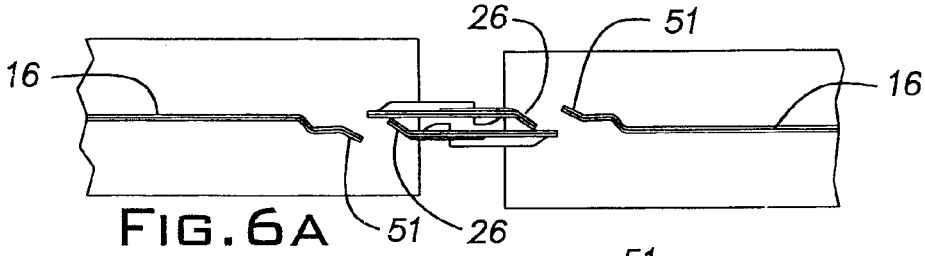
FIGS. 6A–6D show progressive stages of assembly of the opposed connectors and horizontal alignment thereof as viewed from the top of the connectors.
Figure 6B:
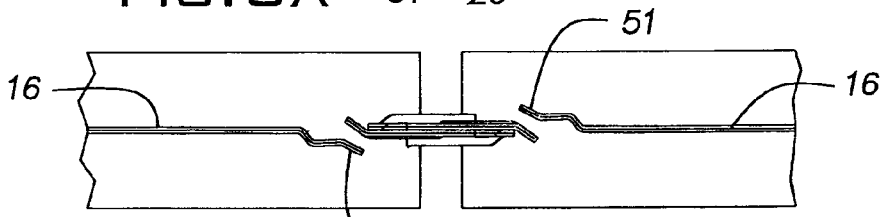
Figure 6C:
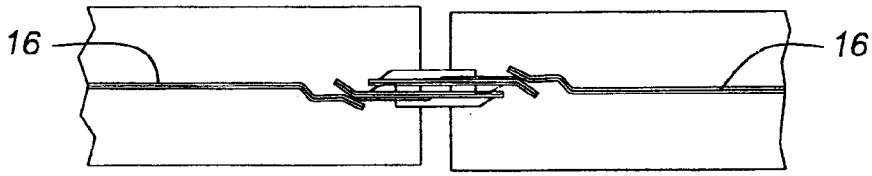
Figure 6D:
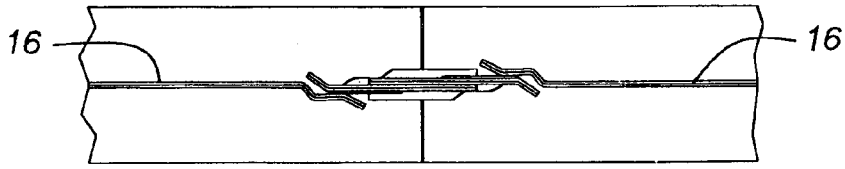
Figure 7:
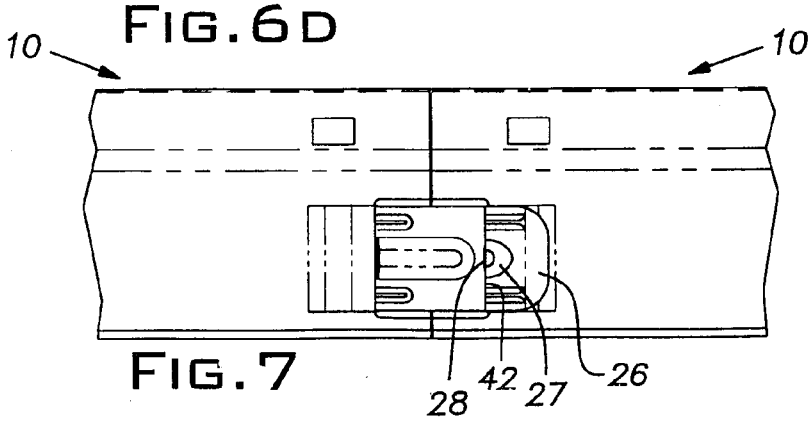
FIG. 7 is a side elevational view of the connectors in their assembled state.

The tab receiving pocket 22 comprises a wall 37 and an opening 38. In the illustrated case, the wall 37 and opening 38 are rectangular and are produced by lancing or cutting the stock of the web 16 along parallel horizontal lines or cuts 39 and a vertical line or cut 42. The pocket wall 37 is integral with the web 16 along a side 43 proximal to the web 16 while the remainder including a distal edge 44 and top and bottom edges 46, 47 are cut free of the web. With particular reference to FIG. 3, the wall 37 is stamped into a non-planar configuration that, for the most part, is spaced laterally outward of the web 16. In this context, the plane of the web 16 is defined as the space occupied by the web proper. A region of the wall 37 proximal to the web 16 forms a hollow by virtue of a step portion 48 bent away from the plane of the web 16 and an intermediate portion 49 bent slightly back toward the plane of the web. The distal end of the pocket wall 37 is formed with an outwardly flared portion 51 at an angle to the plane of the web 16. The wall 37, when viewed in FIG. 3 is re-entrant at the zone of a bend line 52 between the outwardly flared portion 51 and intermediate portion 49 so that this zone 52 is exclusive in its proximity to the plane of the web 16 as compared to adjacent parts of the wall 37.

Figure 8:
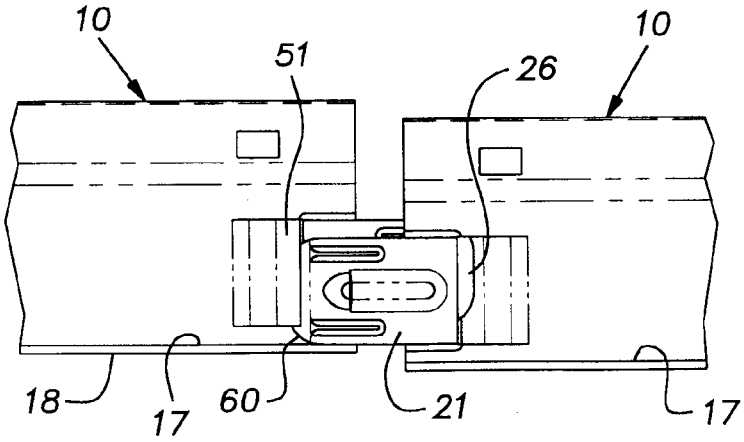
FIG. 8 is a side elevational view of a pair of connectors in a self-aligning condition both in the vertical direction and in the horizontal direction, the latter corresponding to a stage between that shown in FIGS. 6A and 6B.
Figure 2:
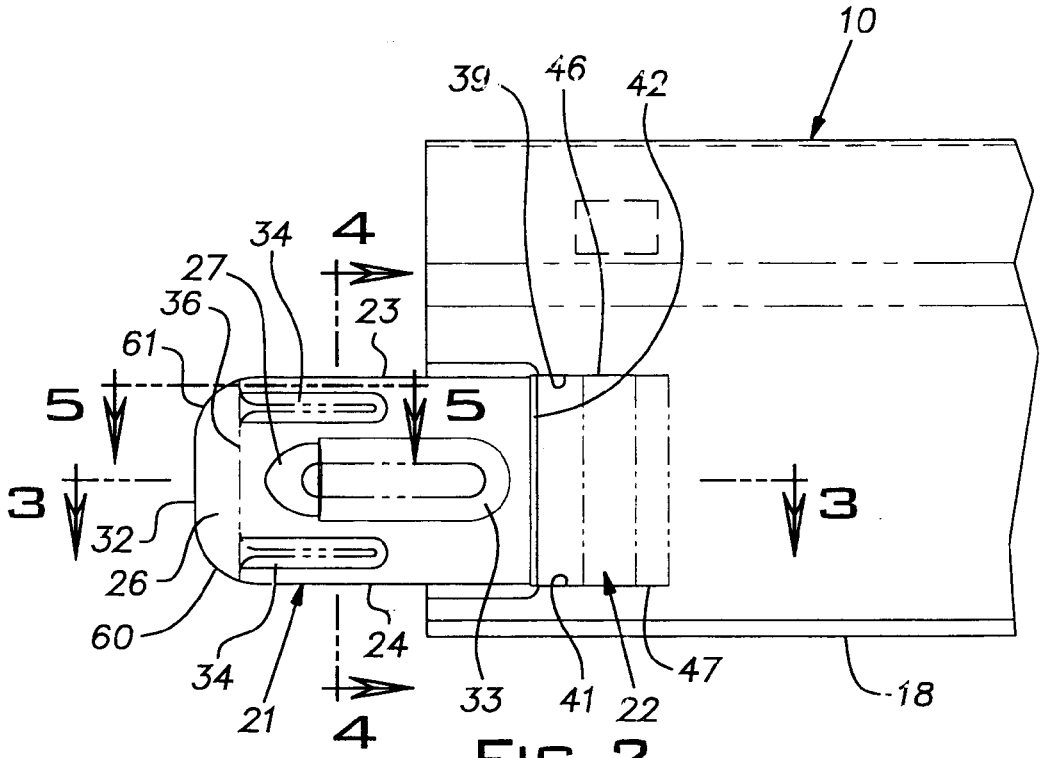
FIG. 2 is a side elevation of an end portion of a main runner or tee and an associated connector.

The connector 20 is adapted to mate with an identical connector as shown in FIGS. 6A–6D and FIG. 7. In this manner, successive main tees or runners 10 are joined together end-to-end to span a room or other space in which a suspended ceiling is to be constructed. An important feature of the connector 20 is its ability to self-align itself to a mating connector. By way of example, FIG. 8 shows a condition where two connectors 20 are being joined together and are initially out of vertical alignment. In the condition of FIG. 8, the connector 20 of one tee 10 is resting on the upper side of a flange 17 of another tee. This condition most typically would be where the higher tee (on the left in FIG. 8) has previously been installed and the lower tee (on the right) is being joined to the previously installed tee. Inspection of FIG. 8 reveals that a lower inclined, curved part 60 of the lead edge 32 has a portion slightly higher than the lower edge of the pocket opening 41 of the opposed connector. Similarly, but not shown, on the opposite side of the tees in FIG. 8, an upper inclined, curved part 61 of the lead edge of the relevant end tab has a portion below the upper opening edge 39 of the connector 20. With the connector 20 urged horizontally or laterally towards the opposite connector, the lead angle end portion 26 slips into the pocket opening 38 of the opposed connector. Longitudinal force applied to the tee 10 being installed causes the inclined edge 60 working against the pocket opening edge 41 of the opposed connector to cam the connector 20 upwardly relative to the opposed connector and thereby self-aligns the connector to the opposed connector. Other shapes for the rounded edge parts 60, 61 capable of shifting the connector up or down when engaging the pocket structure are contemplated. This camming action is augmented by two other camming functions. Cam-like inter-engagement between the lead angle end portion 26 and the outwardly flared portion 51 of the pocket wall 37, at each set of these elements, biases the connectors 20 laterally or horizontally towards one another when the tees are forced axially or longitudinally towards one another. When the lock lances 27 inter-engage with the opposed relief grooves 31, these elements, in response to the lateral or horizontal bias developed by the sets of lead angle end portion 26 and pocket wall flare portion 51 cam the connectors 20 vertically, again in self-alignment action. The result of these combined camming actions is that the connectors 20 are positively self-aligning and are comparatively easy to interconnect.

The relief groove 31 avoids significant interference between the connectors due to the projection of the lock lance 27 until after they have been effectively aligned by the end tabs 21 being substantially received in opposed pocket holes or openings 38. When the lock lances 27 reach the end 33 of the respective relief grooves 31 of their opposed connector 20 continued advance of the tee being installed requires the pocket walls 37 to momentarily resiliently deflect laterally outwardly to allow the lock lances to slide out of the ends of the grooves and over a short distance on the surface of the end tab proper until it passes the cut or edge 42 formed when the pocket wall 37 was made. The re-entrant character of the wall 37 allows the surface area of the bend line 52 to exclusively contact the opposing end tab 21 (between FIGS. 6C and 6D) and assures consistent spring action. At this point, the lock lances 27, under the influence of the spring-like force developed by the deflected resilient pocket walls 37 snap longitudinally behind the edges 42 of the opposed connector thereby completing a connection or splice.

A beneficial result of the disclosed structural features of the connector is that an audible click is produced when the lock lance edges 28 pass over the edges 42 of the pocket openings 38 allowing the end tabs 21 to snap against one another. The click signals the installing technician that a connection has been completed. The loudness of this click is due in part to the geometry of the lock lance edge 28 which is, as discussed, 90° or less, thereby avoiding a condition where if this edge were in a plane greater than 90°, it would slide down the opposed locking edge 42 and mute the click. The beads 34, by stiffening the end tabs 21 in the area of the lock lances 27 add to the loudness of the click.

The lead angle end portions 26 and the flared portions 51 of the pocket walls ensure that only surface-to-surface contact occurs when the greatest interference arises in the connection sequence as the lock lances slide over the land areas between the relief grooves 31 and the locking edges 42 of the openings 38. Contact between the front edge 32 of an end tab 21 or the distal edge 44 of the pocket wall 37 could greatly increase the frictional resistance between the connectors. In part, the re-entrant character of the wall at the bend line 52 avoids such edge contact. With the periphery of the pocket wall, specifically the edges 44, 46 and 47 (apart from where it is joined with the web proper), being free of connection with other parts of the connector, the pocket wall acts as a resilient spring. Consequently, the force to deflect it laterally for passage of the lock lance out of a groove 31 and over the adjacent land to the opening edge 42 is limited. In turn, the force to effectuate a connection is moderate and not prone to vary widely when the connectors 20 are nearly out of tolerance because of material thickness variation, tool wear or other manufacturing conditions. Such wide variation is known to occur in prior art connector designs and is found to be very objectionable to professional installation technicians. The beads 34, in addition to reinforcing the end tab 21 and improving the audible click, serve to avoid excessive friction during a connection where burrs may exist on edges of adjacent parts.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A connector for a runner in a suspended ceiling comprising an end tab and an end tab receiving pocket, the end tab having a lead end with an edge and the receiving pocket being rearward of the end tab, the end tab having a body with generally planar portions rearward of the lead end, the material of the planar body portions defining a plane, the lead end being bent to one side out of the plane of said body portions to form a lead angle, the pocket being proportioned to receive the lead end of an identical connector, the pocket having a wall lying in a zone lateral of the plane of the body portions, the wall having a forward portion flared outwardly away from the plane of the planar body portions, the periphery of the wall being free of attachment from surrounding parts of the connector along a substantial portion of its length rearward of the flared portion whereby the wall operates as a resilient spring, the end tab having a locking projection and a zone for receiving and interlocking with the projection of an identical connector, the wall being arranged to bear against the end tab of the identical connector and maintain the projection of the identical connector in its receiving zone, the configuration of the end tab requiring the wall to deflect laterally outwardly when the end tab of the identical connector is being forced into the pocket, the forward outwardly flared portion of the pocket wall and lead angle portion of the identical connector inter-engaging in a smooth surface-to-surface sliding contact when the end tab of the identical connector is being received in the pocket.

2. A tee for a suspended ceiling including an end connector with an end tab and an end tab receiving pocket, the end tab having a lead end with an edge and the receiving pocket being rearward of the end tab, the end tab having a body with generally planar portions rearward of the lead end, the material of the planar body portions defining a plane, the lead end being formed to one side out of the plane of said body portions, the pocket being proportioned to receive the lead end of an identical connector, the pocket having a wall lying in a zone lateral of the plane of the body portions to the same side to which the lead end is formed, the tee having a lower face and a pair of horizontally diverging flanges adjacent its lower face, the flanges each having an upper side, the edge of the lead end having a configuration such that when the end tab is supported on the upper face of a flange of an identical tee it is adapted to enter the pocket of the identical connector and when an axial installation force is applied the lead edge is arranged to enter the pocket of the connector of the identical tee and align the connectors with each other by a camming action.

3. A connector for a runner in a suspended ceiling comprising an end tab and an end tab receiving pocket, the end tab having a lead end with an edge and the receiving pocket being rearward of the end tab, the end tab having a body with generally planar body portions rearward of the lead end, the material of the planar body portions defining a plane, the lead end being formed to one side out of the plane of said body portions, the pocket being proportioned to receive the lead end of an identical connector, the pocket having a wall lying in a zone lateral of the plane of the body portions, the end tab having a locking projection projecting to a side of the tab to which the lead end is formed and having a rearwardly facing locking edge, the connector having an open zone for receiving the end tab, including the forward end, of an identical connector, the open zone including a rearwardly facing edge to interlock with the locking edge of the projection of the identical projection.

4. A connector as set forth in claim 3, wherein the end tab includes a relief area for receiving the locking projection of an identical connector in assembly motion prior to full locking engagement with the identical connector.

5. A tee for a suspended ceiling, the tee having a central web and an end connector on the web, the connector including an end tab and an end tab receiving pocket, the end tab having a lead end with an edge and the receiving pocket being rearward of the end tab, the pocket being proportioned to receive the lead end of an identical connector, the pocket lying in a zone lateral of the central web, the periphery of the wall being free of attachment from surrounding parts of the connector along a substantial portion of its length in a longitudinal direction of the tee whereby the wall operates as a resilient spring, the lead edge having inclined portions adapted to engage portions of the pocket of an identical opposed connector to vertically align the connectors, the pocket wall being capable of resiliently deflecting laterally of the plane of the web upon interference between the lead end of the identical connector end tab and the pocket to assist in a smooth insertion of the end tab of the identical connector into the pocket.

6. A connector for a runner in a suspended ceiling comprising an end tab and an end tab receiving pocket, the end tab having a lead end with an edge and the receiving pocket being rearward of the end tab, the end tab having a body with generally planar portions rearward of the forward end, the material of the planar body portions defining a plane, the pocket being proportioned to receive the lead end of an identical connector, the periphery of the wall being free of attachment from surrounding parts of the connector along a substantial portion of its length in the direction of the end tab whereby the wall operates as a resilient spring, the end tab including a laterally projecting lock with a rearwardly facing locking edge, the connector having an open zone for receiving the projecting lock of an identical connector including a rearwardly facing edge to interlock with the locking edge of the projecting lock of the identical connector, the wall being arranged to deflect as a spring a distance sufficient to enable the projecting lock of the identical connector to slide over areas of the end tab adjacent the rearwardly facing edge without excessive resistance.

7. A tee for a suspended ceiling, the tee having a central web and opposed flanges extending laterally from a zone adjacent a lower edge of the central web, a connector at an end of the tee and having an end tab and an end tab receiving pocket, the end tab having a lead end with an edge and the receiving pocket being rearward of the end tab, the end tab having a body with generally planar portions rearward of the lead end, the pocket being proportioned to receive the lead end of an identical connector, the edge of the lead end having a configuration such that when the lead end is supported on an upper face of a flange of an identical tee it is adapted to automatically enter the pocket of the identical connector when an axial installation force is applied to the tee and self-align the connectors with each other by a camming action, the end tab having a bulbous lock lance projection extending laterally from the plane of the planar body portions of the end tab and a relief groove vertically aligned with the lock lance, the pocket including a structure to bias the end tab of an identical connector laterally towards the plane of the planar body, inter-engagement of the groove of the identical connector and the lock lance assisting the self-alignment function of the lead edge of the end tab.

8. A tee for a suspended ceiling grid, the tee having a central web, a lower face, a pair of horizontally diverging flanges adjacent its lower face and an end connector on the web, the connector including an end tab and an end tab receiving pocket, the end tab having a lead end with an edge and the receiving pocket being rearward of the end tab, the end tab having a body with generally planar portions rearward of the lead end, the material of the planar body portions defining a plane, the lead end being bent to one side out of the plane of said body portions, the pocket being proportioned to receive the lead end of an identical connector, the pocket having a wall lying in a zone lateral of the plane of the body portions, the flanges each having an upper side, the edge of the lead end having a configuration such that when the lead end is supported on the upper face of a flange of an identical tee, it is adapted to enter the pocket of the identical connector and when an axial installation force is applied the lead edge is arranged to enter the pocket of the connector on the identical tee and align the connectors with each other by a camming action, the wall having a forward portion flared outwardly away from the plane of the planar body portions, the periphery of the wall being free of attachment from surrounding parts of the connector along a substantial portion of its length rearward of the flared portion whereby the wall operates as a resilient spring, the end tab having a locking projection projecting to a side of the tab to which the lead end is formed and having a rearwardly facing locking edge, the connector having an open zone for receiving and interlocking with the projection of an identical connector, the open zone including a rearwardly facing edge to interlock with the locking edge of the projection, the wall being arranged to bear against the end tab of the identical connector and maintain the projection of the identical connector in its receiving zone, the configuration of the end tab requiring the wall to deflect laterally outwardly when the end tab of the identical connector is being forced into the pocket, the forward outwardly flared portion of the pocket wall and lead angle portion of the identical connector inter-engaging in a smooth surface-to-surface sliding contact when the end tab of the identical connector is being received in the pocket.

9. A tee as set forth in claim 8, including a pair of reinforcing beads formed in the end tab and extending horizontally across an imaginary vertical plane passing through the locking projection locking edge.

10. A tee as set forth in claim 8, wherein the locking projection locking edge lies in a plane that is 90° or less from the plane of the body portions.

* * * * *